US005122309A

United States Patent [19]

Moerer

[11] Patent Number: 5,122,309

[45] Date of Patent: Jun. 16, 1992

[54] POROUS CERAMIC WATER DISTRIBUTOR FOR QUENCHING HOT GASES AND TO A METHOD FOR QUENCHING HOT GASES

[75] Inventor: Greg S. Moerer, Parkville, Mo.

[73] Assignee: Miles Inc., Pittsburgh, Pa.

[21] Appl. No.: 599,320

[22] Filed: Oct. 17, 1990

[51] Int. Cl.[5] ..... B01F 3/04

[52] U.S. Cl. ..... 261/95; 261/99; 261/104; 261/DIG. 54

[58] Field of Search ..... 261/DIG. 54, 104, 99, 261/95

[56] References Cited

U.S. PATENT DOCUMENTS

| | | | |
|---|---|---|---|
| 2,941,759 | 6/1960 | Rice et al. | 261/99 |
| 3,009,687 | 11/1961 | Hendriks | 261/DIG. 54 |
| 3,735,559 | 5/1973 | Salemme | 261/104 |
| 3,758,081 | 9/1973 | Prudhon | 261/DIG. 54 |
| 3,888,955 | 6/1975 | Maruko | 261/DIG. 54 |
| 3,959,420 | 5/1976 | Geddes et al. | 261/DIG. 54 |
| 4,172,708 | 10/1979 | Wu et al. | 261/DIG. 54 |
| 4,356,271 | 10/1982 | Francis et al. | 264/43 |
| 4,560,478 | 12/1985 | Narumiya | 55/523 |

*Primary Examiner*—Tim Miles

*Attorney, Agent, or Firm*—Joseph C. Gil; Lyndanne M. Whalen

[57] ABSTRACT

A device for quenching hot gases and to a method for quenching hot gases in which this device is employed. This quenching device includes a porous ceramic water distributor composed of a porous ceramic material, a water distributor plate and a means for feeding water to the water distributor plate. In operation, water is fed to the water distributor plate which then distributes water to the porous ceramic material through which the water flows. The water exiting the porous ceramic material flows down the inner wall of the quenching device.

7 Claims, 1 Drawing Sheet

POROUS CERAMIC WATER DISTRIBUTOR FOR QUENCHING HOT GASES AND TO A METHOD FOR QUENCHING HOT GASES

BACKGROUND OF THE INVENTION

The present invention relates to a device useful in quenching hot gases and to a method for quenching hot gases in which this device is employed.

In production facilities where chemical reactions are carried out at an elevated temperature, the gases generated during the reaction must generally be cooled for further processing if the heat from these gases is not used to generate steam. Devices which have been used to quench these gases (i.e., reduce their temperature) as they exit a reactor include metal quenching tanks and metal tanks lined with a refractory material or acid brick. However, these devices are not adequate for quenching most gases because the wall of the quenching vessel can not be cooled or shielded from the radiant heat. Consequently, the gases do not lose enough heat when passing through the vessel and the walls of the quenching vessels deteriorate. Where the gas exiting the reaction vessel is a hot acid gas, the deterioration of the quenching vessel walls is even more rapid.

SUMMARY OF THE INVENTION

It is an object of the present invention to provide a gas quenching device which cools hot gases more effectively than known devices.

It is also an object of the present invention to provide a hot gas quenching device which does not deteriorate as rapidly as known quenching devices.

It is another object of the present invention to provide a durable device capable of quenching hot acid gas more effectively over longer periods of time than known quenching devices.

It is a further object of the present invention to provide a process for quenching hot gases, particularly hot acid gases which is more effective than known quenching processes.

These and other objects which will be apparent to those skilled in the art are accomplished by passing hot gases through a quenching chamber containing the porous ceramic water distributor of this invention. The porous ceramic water distributor is composed of a layer of porous ceramic material, a water distribution plate positioned adjacent to the porous ceramic material and means for feeding water to the water distribution plate. The layer of porous ceramic material is used to form at least a section of the inner wall of the quenching chamber and the water distribution plate is positioned between the sheet of porous ceramic material and the outer wall of the quenching chamber. In operation, water is fed to the water distribution plate and the water is then distributed over the back surface of the porous ceramic layer. The water then flows through the pores of the porous ceramic material and flows down the surface of the wall of the quenching chamber below the porous ceramic layer.

DETAILED DESCRIPTION OF THE PREFERRED EMBODIMENTS OF THE INVENTION

Figure 1:
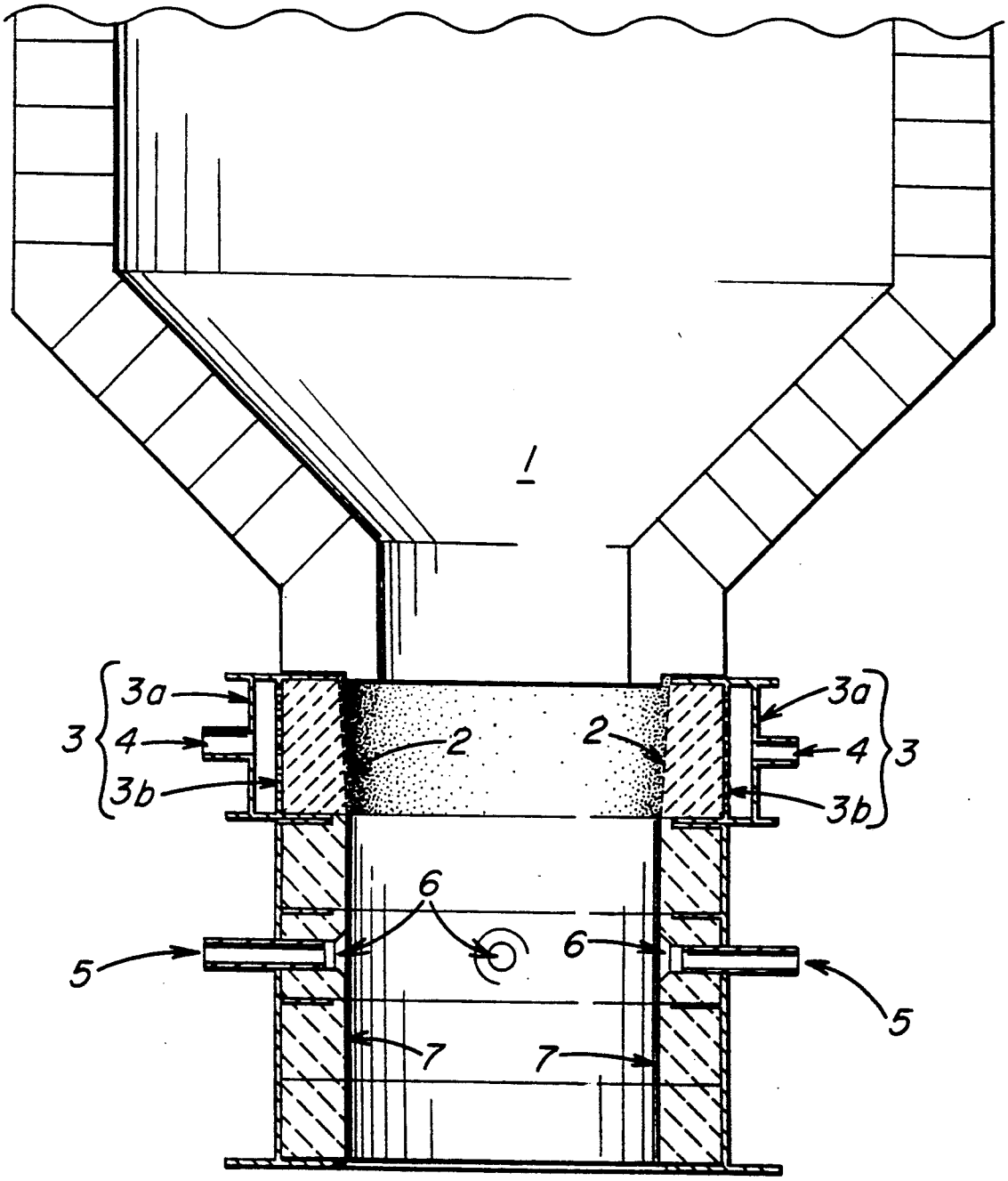
FIGURE 1 illustrates a quenching chamber within the scope of the present invention.

The present invention relates to a device for quenching hot gases, particularly hot gases generated during chemical reactions and to a method for quenching hot gases in which this device is employed. A key feature of the present invention is the porous ceramic water distributor which must be present in the quenching device or quenching chamber of a reactor. The quenching device of the present invention is typically connected or attached to a reaction vessel in a position such that gases exiting the reaction chamber or vessel will pass through the quenching device.

The quenching device illustrated in FIGURE 1 is a typical device within the scope of the present invention. The quenching device of the present invention will therefore be described in detail with reference to FIGURE 1.

The quenching device of the present invention is attached to reaction vessel 1 in a manner such that the gases generated in vessel 1 pass through the quenching vessel. In the device illustrated in FIGURE 1, a sheet of porous ceramic material 2 is positioned at the entrance of the quenching device and forms a first section of the inner wall of the quenching device. Appropriate porous ceramic materials are known. Examples of suitable porous ceramic materials include phosphate-bonded alumina ceramic foams, sintered alumina ceramic foams, cordierite ceramic foams, mullite ceramic foams, partially stabilized zirconia ceramic foams, zirconia-alumina ceramic foams, magnesia ceramic foams, magnesium aluminate ceramic foams and silicon carbide ceramic foams. Such ceramic foams are commercially available from SELEE Corporation, Hendersonville, N.C.. Appropriate porous ceramic materials are also disclosed, for example, in U.S. Pat. No. 4,560,478, U.S. Statutory Invention Registration H48 and U.S. Pat. No. 4,356,271. The porous ceramic material may be in the form of a sheet, brick or block, or any other form which will allow it to form at least a portion of the wall of the quenching device. Selection of the preferred porous ceramic material will, of course, depend upon the specific gases to be passed through the quenching device.

Behind the porous ceramic material 2 and on the surface of the outer wall of the quenching device is water distribution plate 3. Water distribution plate 3 may be made of an appropriate metal with a inner and outer face. The outer face **3*a* contains water under pressure and forces it through a inner face. The inner face 3*b*** consists of a plate with holes drilled in said plate which are designed to provide even water flow distribution to the porous ceramic layer. The porous ceramic layer is very near the metal surface and in fact may be made using the metal water distribution plate as a "mold" distribution plate. The water distribution plate should be rigid enough to prevent stress or strain on the porous ceramic. The porous ceramic is "held in place" by the water distribution plate.

Water is fed to water distribution plate 3 through inlet(s) 4. Inlet(s) 4 should have a circumference large enough to allow water to pass to distribution plate 3 at a rate sufficient to exceed evaporative water loss from the surface of the porous ceramic to the surrounding gas stream. The remaining water should be sufficient to form at least a ¼ inch (0.6 cm), preferably from about ¼ inch to about 1 inch (0.6–2.5 cm) layer of water on the porous ceramic face and on the adjacent acid or refractory brick.

Water is also fed to the quenching chamber shown in FIGURE 1 via water inlet 5 and wall opening 6. A spray generating device such as a nozzle is preferably positioned at wall opening 6 but is not necessary to the invention.

Acid or refractory brick 7 is used to increase the length of the quenching chamber sufficiently to allow the hot gases to reach the desired temperature. The refractory brick 7 must form a surface of the inner wall but need not be used to form the outer wall of the quenching device. Suitable acid and refractory brick materials are known and commercially available to those skilled in the art. Selection of the most preferred refractory brick will, of course, depend upon the specific gases to be passed through the quenching device.

In operation, hot gas leaving reaction vessel 1 enters the quenching device and passes through that section of the quenching device having the porous ceramic material 2 as its inner wall surface. Water is fed via inlet 4 to water distribution plate 3 which then distributes the water through the pores of the porous ceramic material 2 to the inner wall surface. The water exiting the porous ceramic material 2 flows down the inner wall surface of the quenching device as the hot gas passes through. Simultaneously, water is injected via inlet 5 through opening 6 to the lower section of the quenching device. The water exiting opening 6 flows into the lower section and further reduces the gas temperature.

The length of the quenching device of the present invention is generally from about 3 feet to about 30 feet (i.e. about 0.9 to about 9 meters). In theory, it would be possible to form the entire inner wall of the quenching device from porous ceramic material. However, it is more economical to use the porous ceramic material in combination with refractory brick. Where refractory brick is used, the porous ceramic material must be used in an amount such that a water layer of substantially uniform thickness (usually between about ¼–1 inch (0.6–2.5 cm)) forms over the refractory brick. Multiple levels of a porous layer between refractory layers may be employed to achieve this uniform water layer.

It is also possible to place the porous ceramic water distributor (i.e., ceramic material 2, water distributor plate 3 and water inlet 4) in a position other than the entrance of the quenching chamber as is illustrated in FIGURE 1. Where the ceramic water distributor is not placed at the entrance, it will be necessary to determine whether the selected site is sufficiently distant from the exit point of the quenching device to reduce the temperature of the hot gas to the desired temperature. The appropriateness of the selected site can be readily determined and if the site of the porous ceramic water distributor is not sufficiently distant from the gas exit point to allow the desired temperature reduction, the length of the quenching device can be adjusted (e.g., by adding more refractory brick below the porous ceramic water distributor) or additional water sprays (6) may be added. It is, however, generally preferred that the porous ceramic water distributor be placed in the first half of the quenching device through which the hot gas passes, preferably in the first quarter.

The quenching device of the present invention is useful in reducing the temperature of hot gases by as much as 1000° C., generally from about 1100° to about 100° C. The quenching device of the present invention is particularly useful in reducing the temperature of hot acid gases because the acid is at least partially neutralized as it passes through the water coated quenching device and does not directly attack the inner wall surface. Consequently, the quenching device of the present invention is more durable in harsh chemical environments than the quenching devices of the prior art.

Although the invention has been described in detail in the foregoing for the purpose of illustration, it is to be understood that such detail is solely for that purpose and that variations can be made therein by those skilled in the art without departing from the spirit and scope of the invention except as it may be limited by the claims.

What is claimed is:

1. An apparatus for quenching hot gases such as those exiting a reaction vessel comprising a quenching chamber that includes a porous ceramic water distributor which is composed of a porous ceramic material positioned to form at least a section of the wall of the quenching chamber, a water distribution plate positioned behind the porous ceramic material and means for feeding water to the water distribution plate.

2. The apparatus of claim 1 in which the quenching chamber further includes means for spraying cooling water through gases which have passed through the porous ceramic water distributor.

3. The apparatus of claim 1 in which water passing through the porous ceramic water distributor flows down a section of the quenching chamber having walls made of acid or refractory brick.

4. The apparatus of claim 1 in which the porous ceramic material is selected from the group consisting of phosphate-bonded alumina ceramic foams, sintered alumina ceramic foams, cordierite ceramic foams, mullite ceramic foams, partially stabilized zirconia ceramic foams, zirconia-alumina ceramic foams, magnesia ceramic foams, magnesium aluminate ceramic foams and silicon carbide ceramic foams.

5. A process for quenching hot gases comprising passing a hot gas through the quenching chamber of claim 1.

6. A process for quenching hot gases comprising passing a hot gas through the quenching chamber of claim 2.

7. A process for quenching hot gases comprising passing a hot gas through the quenching chamber of claim 3.

* * * * *